US007736276B2

(12) United States Patent
Chuang et al.

(10) Patent No.: US 7,736,276 B2
(45) Date of Patent: Jun. 15, 2010

(54) ILLUMINATING WRIST EXERCISER

(76) Inventors: Yun Yu Chuang, 7F., No. 25, Alley 8, Lane 120, Guangrong Rd., Lujhou City, Taipei County 247 (TW); Ming Hung Lin, 4F., No. 55, Sec. 2, JHongsiao Rd., Sanchong City, Taipei County 241 (TW); Pei Sung Chuang, No. 20, Alley 13, Lane 122, Zihciang Rd., Danshuei Township, Taipei County 251 (TW)

( * ) Notice: Subject to any disclaimer, the term of this patent is extended or adjusted under 35 U.S.C. 154(b) by 0 days.

(21) Appl. No.: 12/543,771

(22) Filed: Aug. 19, 2009

(65) Prior Publication Data

US 2010/0048359 A1 Feb. 25, 2010

(30) Foreign Application Priority Data

Aug. 22, 2008 (TW) ..... 97215084 U

(51) Int. Cl.
*A63B 26/16* (2006.01)

(52) U.S. Cl. ..... 482/44; 482/45; 446/235; 446/233

(58) Field of Classification Search ..... 482/127, 482/44–46

See application file for complete search history.

(56) References Cited

U.S. PATENT DOCUMENTS

| | | | | |
|---|---|---|---|---|
| 6,623,405 | B2 * | 9/2003 | Chuang et al. | 482/44 |
| 6,770,012 | B2 * | 8/2004 | Kuo | 482/44 |
| 7,101,315 | B2 * | 9/2006 | Chuang et al. | 482/44 |
| 2008/0058166 | A1 * | 3/2008 | Chuang et al. | 482/44 |

* cited by examiner

*Primary Examiner*—Jerome Donnelly
(74) *Attorney, Agent, or Firm*—Morris Manning & Martin LLP; Tim Tingkang Xia, Esq.

(57) ABSTRACT

An illuminating wrist exerciser includes upper and lower casing members, a ring, a rotor, a magnetic element, an illumination control circuit board, a plurality of illuminators, and a coil holder. The upper and lower casing members mate each other to form an interior space receiving the rotor therein. The upper casing member forms in a top portion thereof an opening to partially expose the rotor. Opposite ends of the rotor are rotatably coupled to the ring surrounding the rotor. The magnetic element is mounted to the ring. The illumination control circuit board and the coil holder are received in a recess defined in one of the ends of the rotor. The coil holder forms a bore in which the magnetic element is received. The coil holder carries thereon at least one pair of coils. The illuminators are distributively arranged on an outer surface of the rotor and are electrically connected to the illumination control circuit board. Electrical power is induced by the magnetic interaction between the coils of the coil holder and the magnetic element and is fed to the illumination control circuit board, which in turn controls the lighting/darkening of the illuminators to thereby provide a power-generation, illuminating wrist exerciser.

17 Claims, 9 Drawing Sheets

ILLUMINATING WRIST EXERCISER

BACKGROUND OF THE INVENTION

1. Field of the Invention

The present invention relates to an illuminating wrist exerciser, and in particular to a wrist exerciser that features rotation based power generation and includes parts for high-performance magnetic-field induced power generation and light emission.

2. The Related Arts

Wrist exercisers are widely known in exercising and training wrist-related muscles, especially for rehabilitation and therapy purposes. Examples of the wrist exercisers are illustrated in Taiwan Utility Model No. 135058 and U.S. Pat. No. 5,800,311, wherein a wrist training sphere that is operated with rotary motion thereof is provided with structures of power generation and light-emitting diode so that forcibly pulling a rope wound around a rotor to initiate rotation of the rotor causes electromagnetic interaction in a face-to-face manner between windings mounted to the rotor and magnets mounted to a casing that houses the rotor to induce electrical power for lighting the light-emitting diodes. Such structures add extra functions and surface decorations to the wrist training devices.

However, in the conventional structures of power generation and lighting elements of the known wrist training devices, the electromagnetic interaction between the magnets and the windings suffers insufficiency of power generation due generally to a large magnet gap and high magnetic leakage, which leads to relatively high magnetic reluctance, high magnetic leakage, and relatively small magnetic flux in the electromagnetic interaction, and consequently, when the rotor is in a low speed rotation, the lighting performance of the light-emitting diodes is poor, and such a problem is only overcome by increasing the rotational speed of the rotor.

In addition, other prior art references are also known, such as Taiwan Utility Model No. 580942, which discloses an "illuminating wrist exerciser ball" having a construction similar to those disclosed in Taiwan Utility Model No. 135058 and U.S. Pat. No. 5,800,311. A difference resides in that magnetic elements are provided, on surfaces thereof, alternating and adjacent positive and negative magnetic zones (namely a plurality of opposite polarities of "N" and "S") and a slide ring and an extension of a brush are set corresponding to the alternating positive and negative magnetic zones of the magnetic elements, whereby by means of the corresponding arrangement of the slide ring and the brush, windings and light-emitting diodes are connected to generate electrical power to light the light-emitting diodes. This arrangement similarly suffers the problems of large magnet gap, high magnetic reluctance, and high magnetic leakage and consequently, poor performance of power generation and lighting of light-emitting diodes. Further, the alternating arrangement of multiple positive and negative magnetic zones makes the magnetic elements and the construction of the slide ring and the brush complicated, which causes difficult in assembling and maintenance, leading to increased costs of manufacturing and maintenance. This is adverse to the industry. Further, the slide ring, the brush, and an internal support ring induces frictional resistance, high level noise and part wearing during the rotation of the rotor, and eventually reducing the operation performance and the lifespan of the wrist training devices.

SUMMARY OF THE INVENTION

The present invention is made to overcome the problems of poor performance of power generation and lighting of light-emitting diodes due to the face-to-face arrangement between magnetic elements and windings forming an electromagnetic interaction configuration that has a large magnet gap, high magnetic leakage, high magnetic reluctance, and low magnetic flux and also has complicated components that are adverse to assembling and maintenance, as well as increased costs of assembling and maintenance, which factors are certainly adverse to the industry, and the problems associated with frictional resistance, high level noise, and parts wearing occurring in the operation of the conventional wrist training devices.

Accordingly, aiming to solve the above problems, the present invention provides an illuminating wrist exerciser, comprising upper and lower casing members, a ring, a rotor, a magnetic element, an illumination control circuit board, a plurality of illuminators, and a coil holder. The upper and lower casing members mate each other to form an interior space receiving the rotor therein. The upper casing member forms in a top portion thereof an opening to partially expose the rotor. Opposite ends of the rotor are rotatably coupled to the ring surrounding the rotor. The magnetic element is mounted to the ring. The illumination control circuit board and the coil holder are received and retained in a recess defined in one of the ends of the rotor. The coil holder forms a bore in which the magnetic element is received. The coil holder carries thereon at least one pair of coils. The illuminators are distributively arranged on an outer surface of the rotor and are electrically connected to the illumination control circuit board. Electrical power is induced by the electromagnetic interaction between the coils of the coil holder and the magnetic element and is fed to the illumination control circuit board, which in turn controls the lighting/darkening of the illuminators to thereby provide a power-generation, illuminating wrist exerciser.

The effectiveness of the illuminating wrist exerciser of the present invention is that a high performance power generation and lighting structure featuring small magnet gap, low magnetic reluctance, and high magnetic flux is realized in a coplanar and co-axial configuration to improve the lighting performance of the light-emitting diodes. Further, the ring, the rotor, the magnetic element, the coil holder, the illumination control circuit board, and the plurality of illuminators are of simple structures, so that the costs of assembling and maintenance of the illuminating wrist exerciser are substantially reduced. Further, the electromagnetic induction structure between the magnetic element and the coils does not induce any frictional resistance and wearing of parts, and reduces the noise level occurring during the operation thereof. Thus, the industrial value of the illuminating wrist exerciser of the present invention is enhanced.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
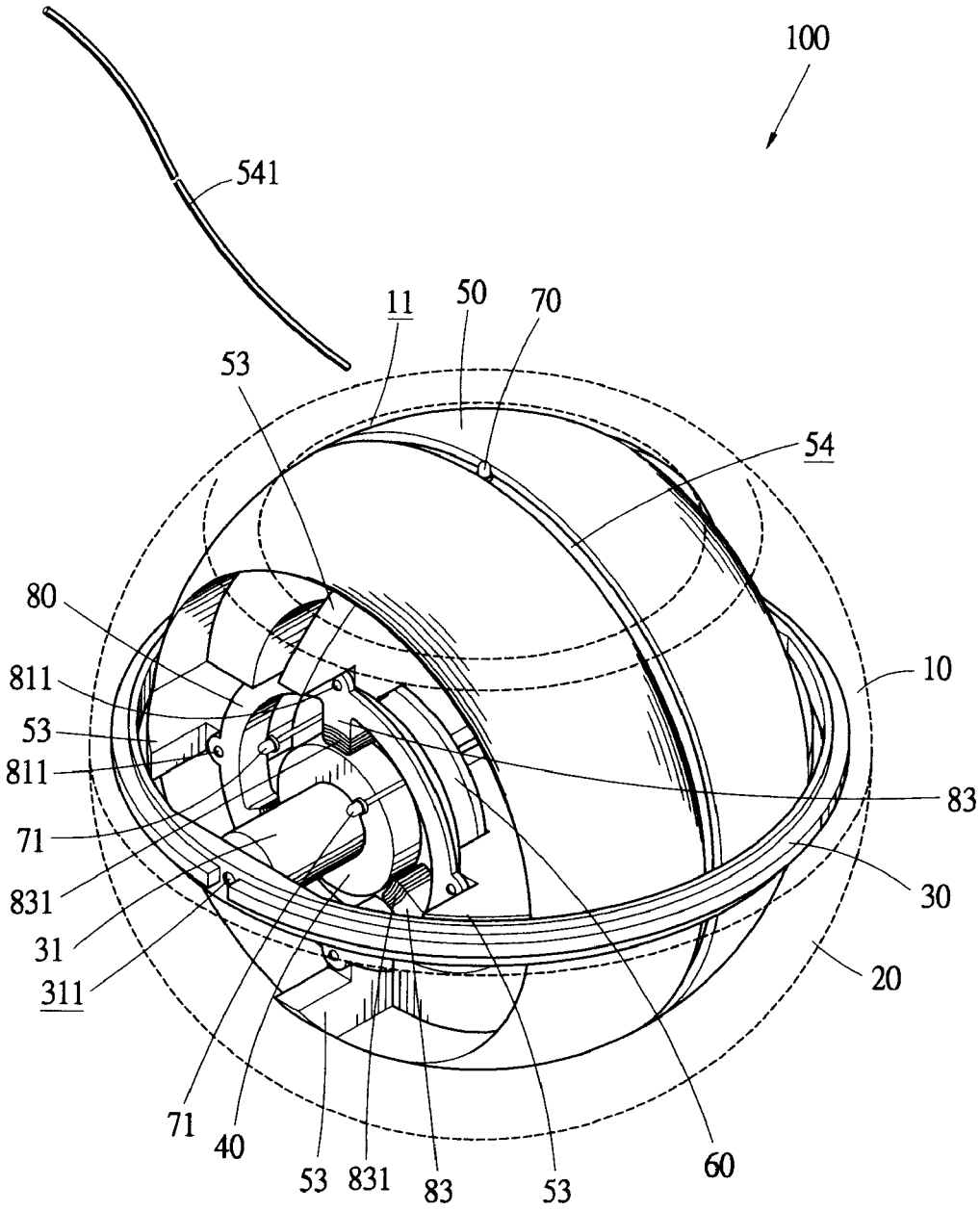
FIG. 1 is a perspective view showing an illuminating wrist exerciser constructed in accordance with a first embodiment of the present invention.
Figure 2:
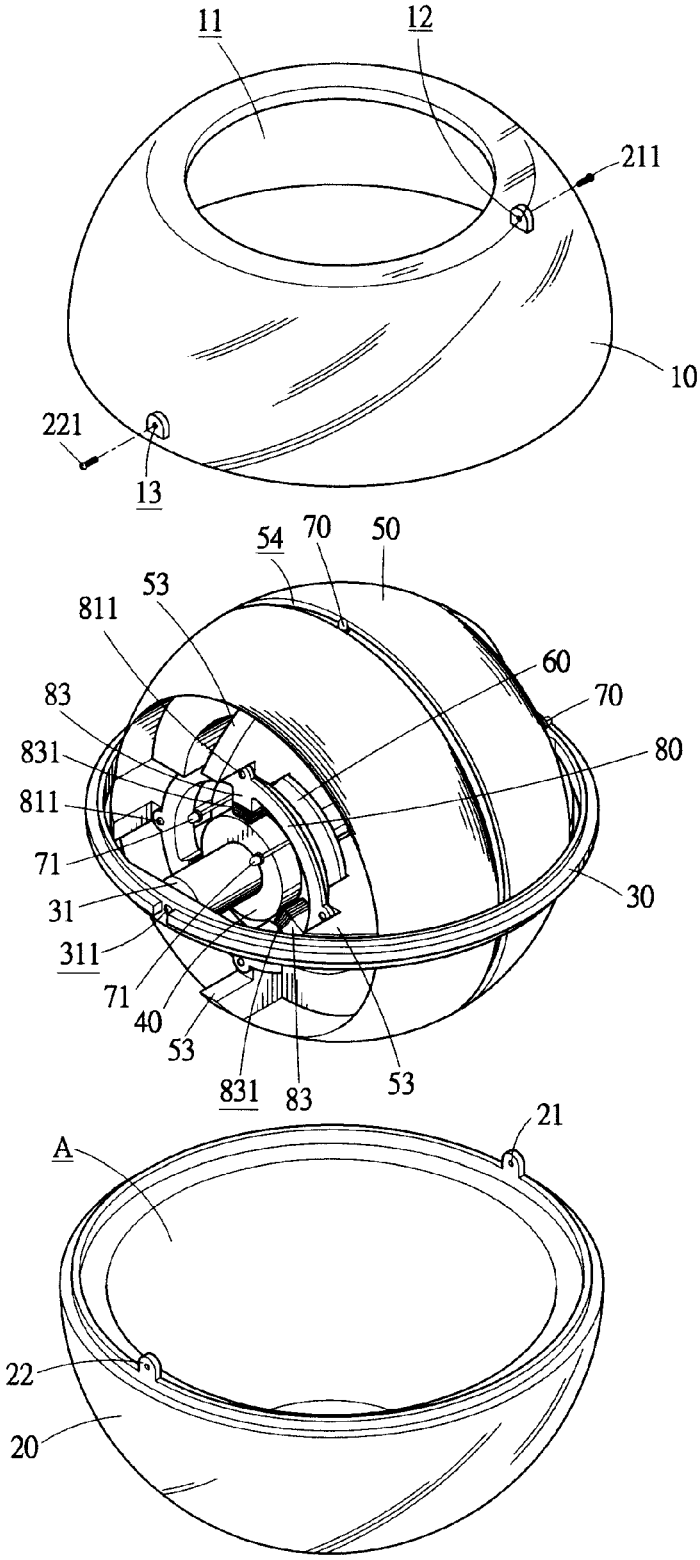
FIG. 2 is an exploded view of the illuminating wrist exerciser of FIG. 1.
Figure 3:
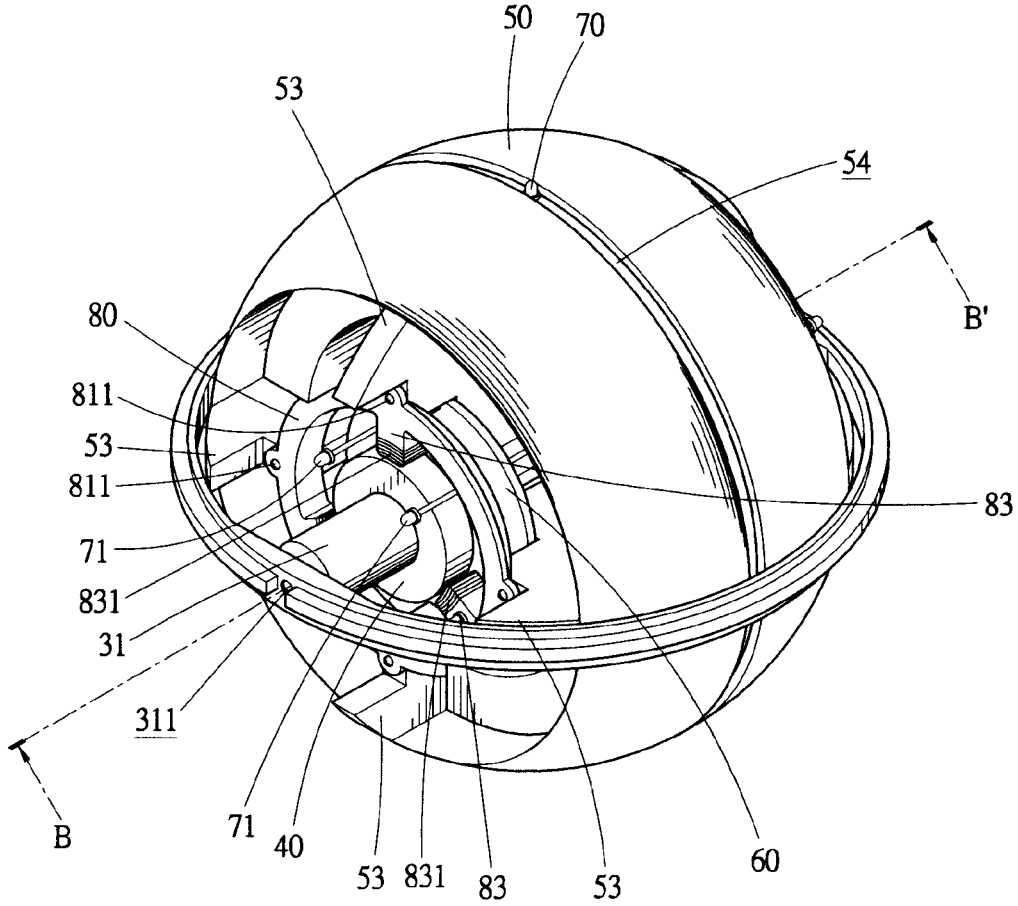
FIG. 3 is an perspective view of a rotor of the wrist exerciser of FIG. 1, taken from a different perspective.
Figure 4:
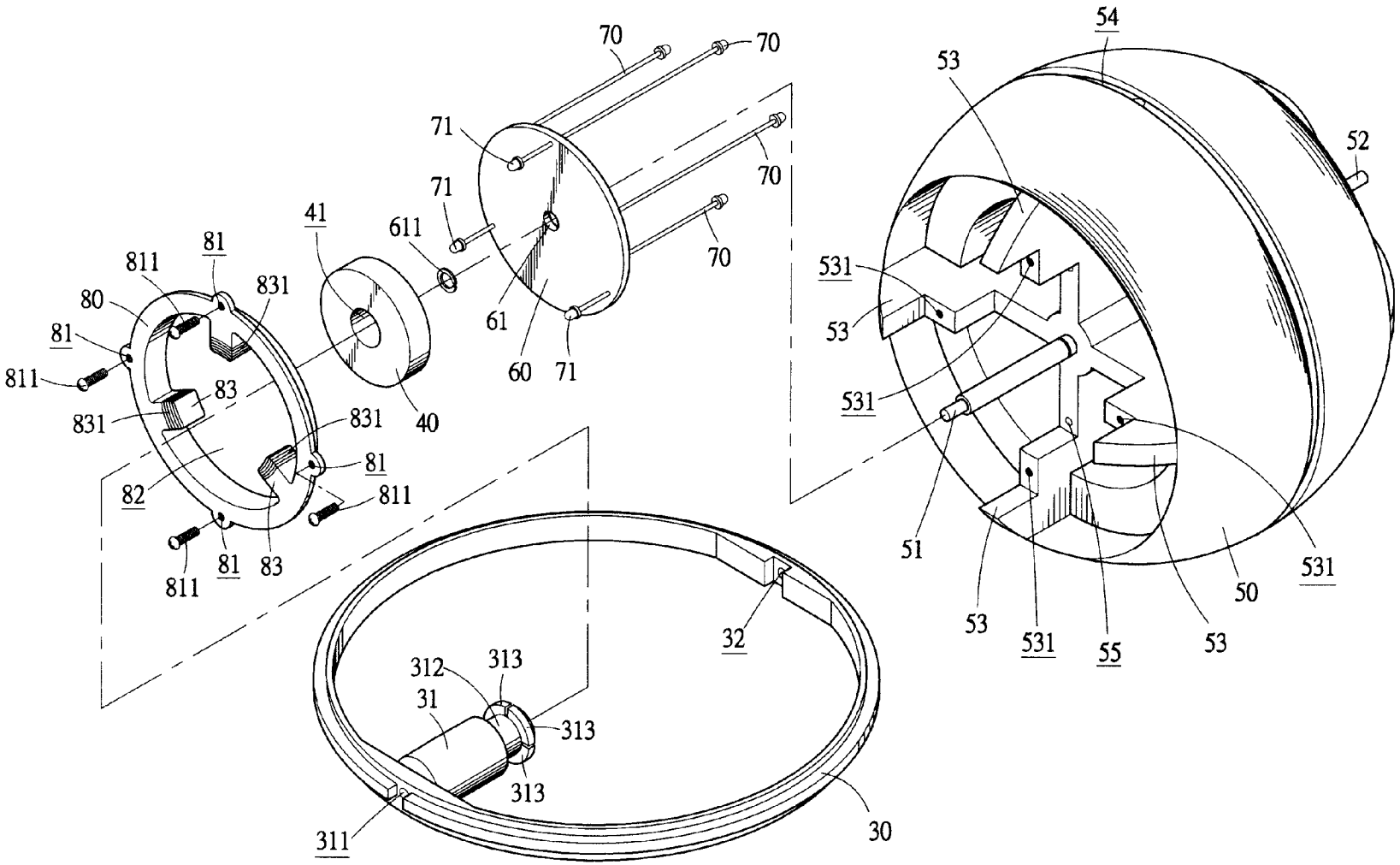
FIG. 4 is an exploded view of the rotor of FIG. 3.

With reference to the drawings and in particular to FIGS. 1-4, an illuminating wrist exerciser constructed in accordance with the present invention, generally designated with reference numeral 100, comprises a casing made up of an upper casing member 10 and a lower casing member 20, both being hollow and releasably coupled to each other. An opening 11 is defined in a top portion of the upper casing member 10. The upper casing member 10 has a lower circumferential edge forming a pair of slots 12, 13 and the lower casing member 20 has an upper circumferential edge on which a pair of lugs 21, 22 is formed. By having the slots 12, 13 of the upper casing member 10 fit over and mating the lugs 21, 22 of the lower casing member 20 and further having bolts 211, 221 respectively extending therethrough and fixing them together, the upper and lower casing members 10, 20 are coupled together, defining therein an interior space A. It is noted that the coupling between the upper casing member 10 and the lower casing member 20 is not limited to the coupling realized by fitting the lugs 21, 22 into the slots 12, 13 and can be of any configuration that provides an equivalent function.

A ring 30 is set on the upper circumferential edge of the lower casing member 20. The ring 30 forms a joint seat 31 and a hole 32 that are opposite to each other. The joint seat 31 forms a bore 311. The joint seat 31 has an inner end forming a coupling section 312 that is provided, at a free end thereof, resilient retention tabs 313.

A magnetic element 40 forms therein a hole 41 that corresponds to and is fit over the coupling section 312 of the joint seat 31 of the ring 30 in such a way that in the course of fitting, the resilient retention tabs 313 are deformed inward to allow the hole 41 to fit onto the coupling section 312, and thereafter the resilient retention tabs 313 resiliently restore their original shapes to thereby securely fix the magnetic element 40 on the coupling section 312. The magnetic element 40 is not limited to any specific type and a magnetic ring is taken as an example in the instant embodiment.

The coupling between the magnetic element 40 and the ring 30 is not limited to that realized through fitting the hole 41 to the coupling section 312 and retaining by the resilient retention tabs 313. Other equivalent structures, such as coupling of the magnetic element 40 to the ring 30 through adhesives or threading, can also be used and are considered within the scope of the present invention.

A rotor 50, which has a spherical configuration in the embodiment illustrated, comprises two axles 51, 52 substantially co-axial and extending in opposite directions from opposite axial ends of the rotor 50. The axle 51 forms at least one circumferential groove 511. The axle 51 is fit into the bore 311 of the joint seat 31 and the axle 52 is fit into the hole 32 defined in the ring 30 so that the opposite sides of the rotor 50 are rotatably mounted inside an inner circumference of the ring 30 with a portion of the rotor 50 projecting beyond the opening 11 of the upper casing member 10.

One of the axial ends of the rotor 50 forms a recess in which a plurality of mounting portions 53 is formed. Each mounting portion 53 forms an inner-threaded hole 531. The rotor 50 has a circumferential curved surface in which at least one circumferential slot 54 is defined. The rotor 50 also forms a plurality of through holes 55. The circumferential slot 54 functions to receive a rope 541 received therein and wound therearound so that forcibly pulling the rope 541 causes the rotor 50 to start rotating.

Figure 5:
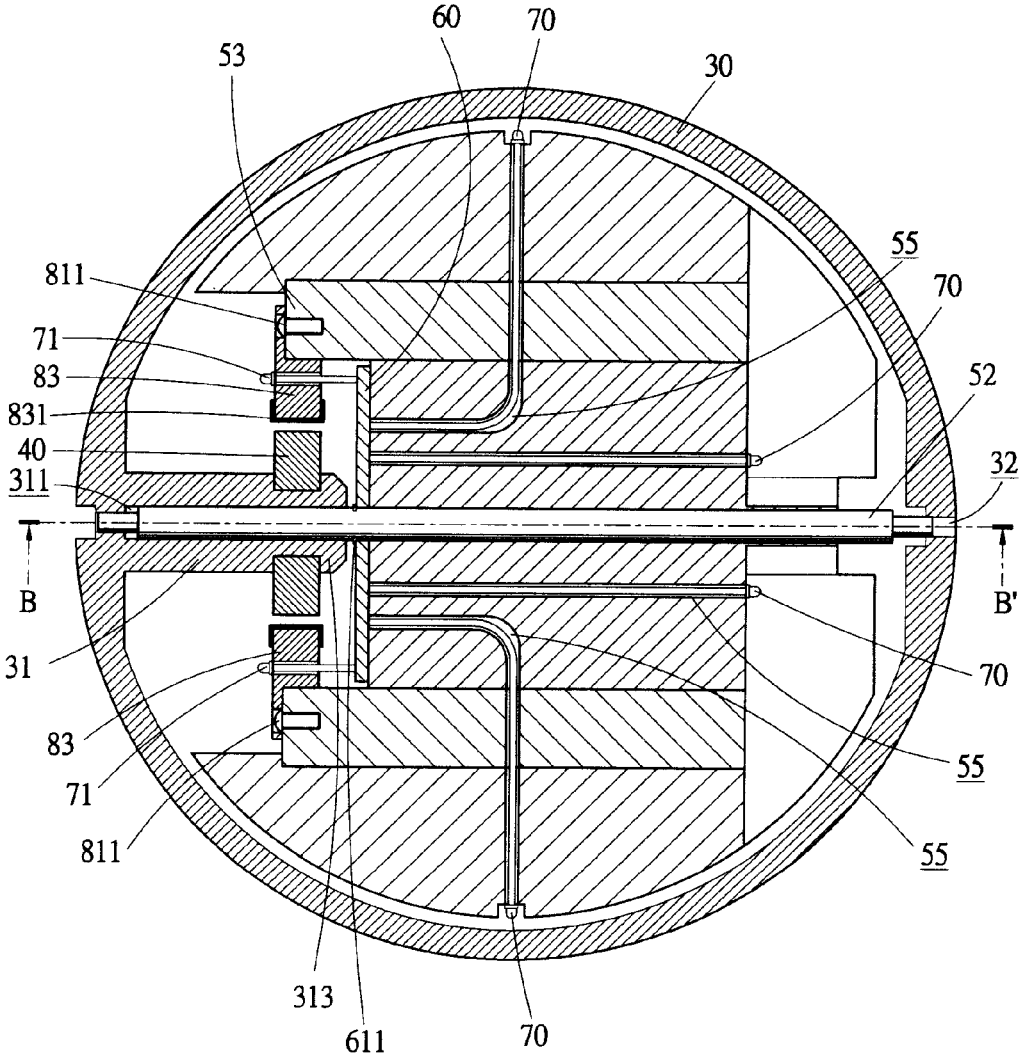
FIG. 5 is cross-sectional view taken along line B-B' of FIG. 3.

Also referring to FIG. 5, an illumination control circuit board 60 forms a hole 61 that is fit over the axle 51 and a C-clip 611 is fit in the groove 511 of the axle 51 to securely retain the illumination control circuit board 60 against an inside surface on the end of the rotor 50 where the axle 51 extends. The coupling of the illumination control circuit board 60 to the rotor 50 is not limited to above described structure and can be realized through other equivalent means, such as adhesives and threading engagement, which are considered within the scope of the present invention. The illumination control circuit board 60 has functions of power conversion and illumination control.

A plurality of illuminators 70, 71, which is not limited to any specific type and is embodied as light-emitting diodes in the embodiment illustrated, is electrically coupled to the illumination control circuit board 60 to be controlled thereby for selectively turning on/off for lighting. The illuminators 70 are received in the through holes 55 defined in the rotor 50 (see FIG. 5) in such a way that the illuminators 70 are exposed and give off light through openings of the through holes 55 that are formed in the circumferential surface of the rotor 50. Thus, the illuminators 70 are seemingly arranged on the circumferential surface of the rotor 50.

A coil holder 80 forms a plurality of mounting holes 81 that corresponds in location to the inner-threaded holes 531 of the mounting portions 53 of the rotor 50 so that bolts 811 are received through the mounting holes 81 to engage the inner-threaded holes 531 for fixing the coil holder 80 inside the recess at the end of the rotor 50. The fixing of the coil holder 80 to the rotor 50 is not limited to using bolts to engage the mounting portions 53 and can be realized through any other equivalent means, such as adhesives or equivalent fastening means, which are considered within the scope of the present invention.

The coil holder 80, which is in the form of an annular member in the embodiment illustrated, has an inner circumference that defines a bore 82. The bore 82 is sized to surround the magnetic element 40. The inner circumference of the coil holder 80 forms at least a pair of inward-projecting coil retention stems 83. Three coil retention stems 83 are taken as an example in the embodiment illustrated. Each coil retention stem 83 receives and retains thereon at least one coil or winding 831 so that the coil 831 is located along an outside circumference of the magnetic element 40 and is located on the same plane as the magnetic element 40 to realize a positional arrangement of small magnet gap, low magnetic reluctance, low leakage and high flux (see FIG. 5). The coils 831 are electrically connected to the illumination control circuit board 60. Also, the angular spacing between adjacent coil retention stems 83 provides a space for the extension and exposure of the illuminators 71.

The positional arrangement of the illuminators 70, 71 is not limited to the above described through holes 55 and the spacing between the coil retention stems 83.

Figure 6:
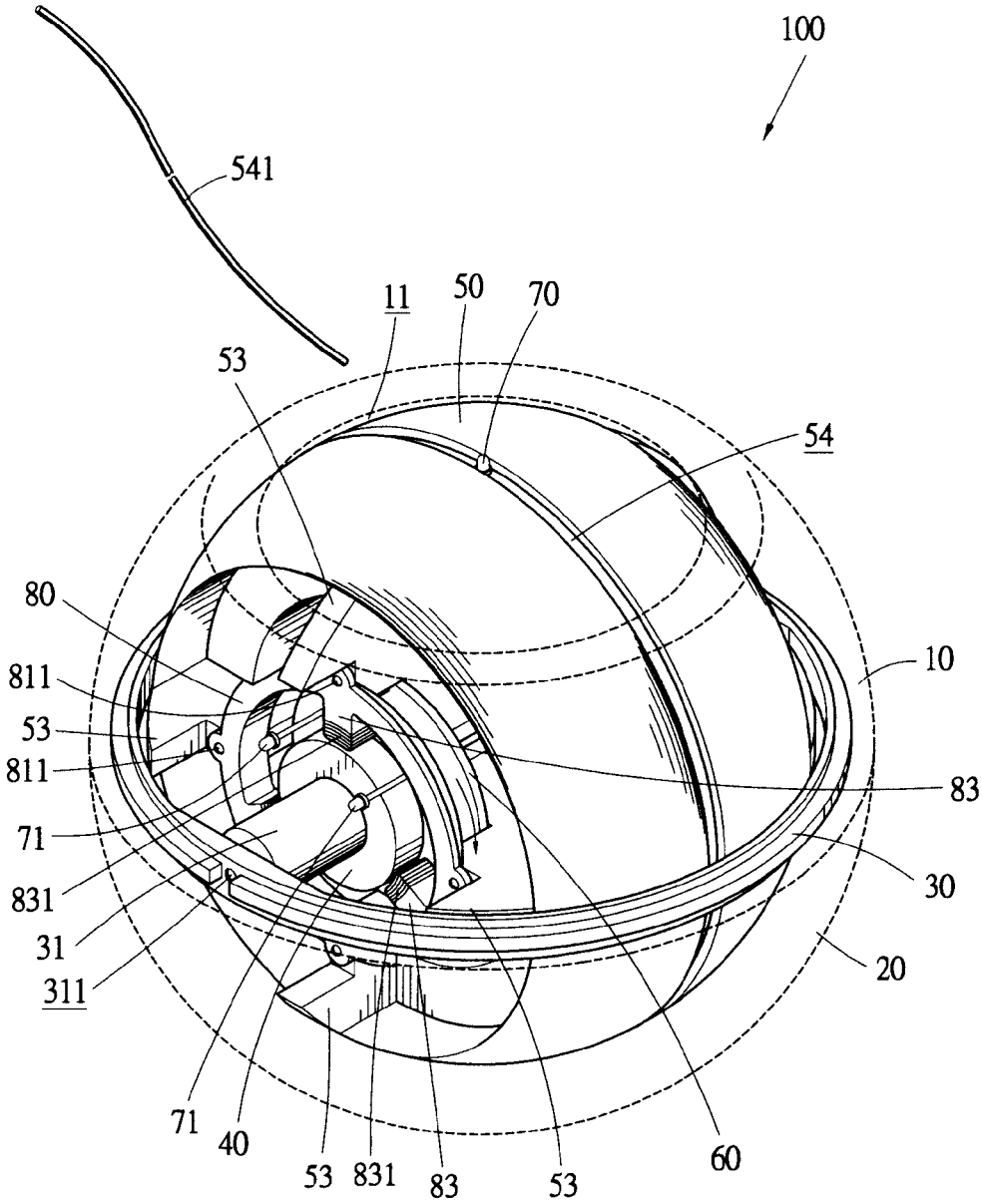
FIG. 6 is a perspective view showing an application of the wrist exerciser of the present invention.
Figure 7:
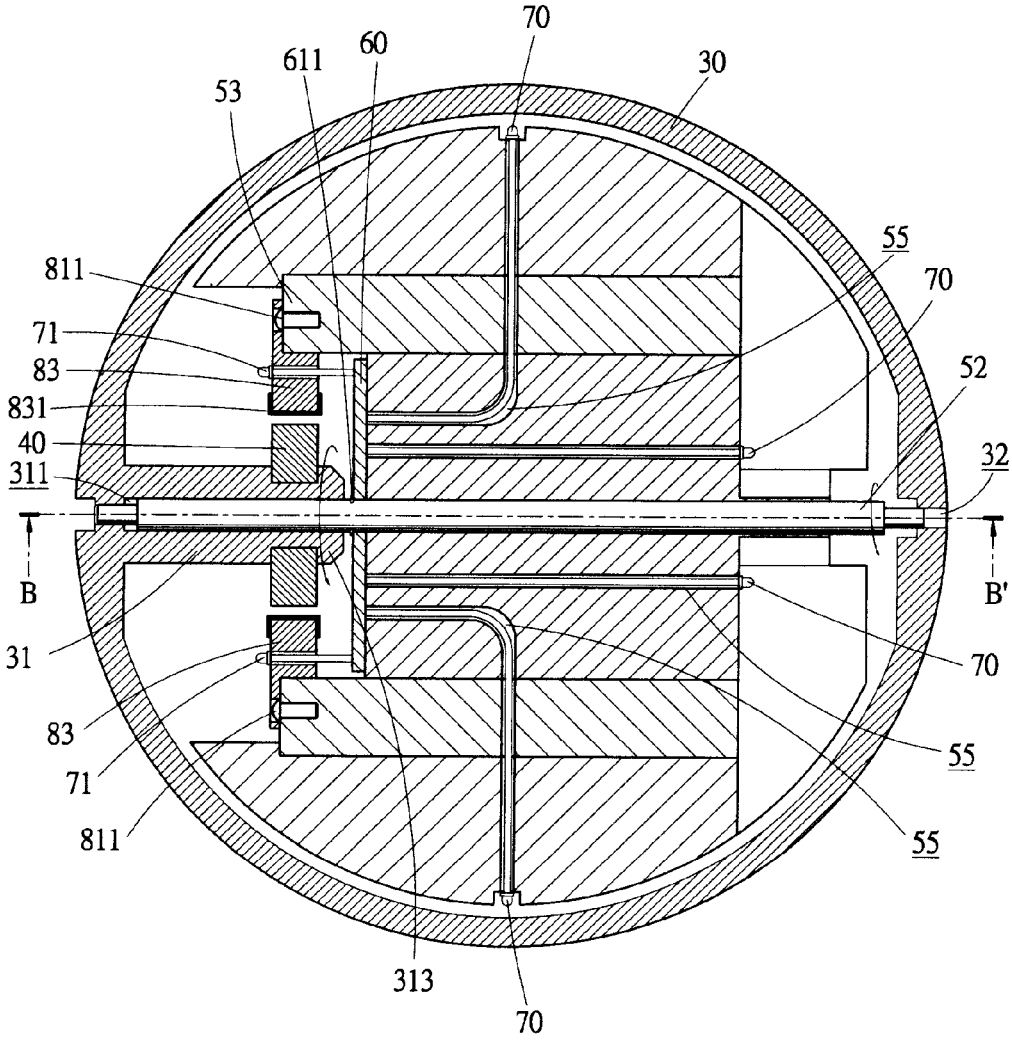
FIG. 7 is a cross-sectional view illustrating the rotation of the rotor and the lighting of illuminators mounted on the rotor.

Also referring to FIGS. 6 and 7, an application of the illuminating wrist exerciser 100 in accordance with the present invention is given. The rope 541 is wrapped around the slot 511 of the rotor 50 to allow a user to forcibly pull with one hand for causing rotation of the rotor 50 (as indicated by the arrows in FIGS. 6 and 7). The user may then use another hand rotating or rocking the illuminating wriest exerciser 100 by holding on the casing constituted by the upper and lower casing members 10, 20 to accelerate and maintain the rotation of the rotor 50 inside the casing. During the rotation of the rotor 50, the magnetic element 40 maintains fixed, while the coils 831 on the coil retention stems 83 of the coil holder 80 rotate with the rotor 50 in such a way that synchronous rotation co-axially around and co-planar with the magnetic element 40 is realized to induce electricity on each coil 831 that is supplied to and subjected to conversion by the illumination control circuit board 60. With the illumination control circuit board 60 so energized and the power so converted by the illumination control circuit board 60, properly-processed electrical power is the supplied to the illuminators 70, 71 for driving and controlling of lighting thereof. Thus, when the rotor 50 is set in rotation, the illuminators 70, 71 are simultaneously set in operation to give of light.

The way to cause the rotation of the rotor 50 is not limited to what described above with the rope 541 wound around the slot 511 of the rotor 50 then forcibly pulled. Other ways, such as rotating the rotor 50 with a user's finger contacting and pushing the rotor 50 or employing other assisting device, can also be used and those are considered within the scope of the present invention.

Figure 8:
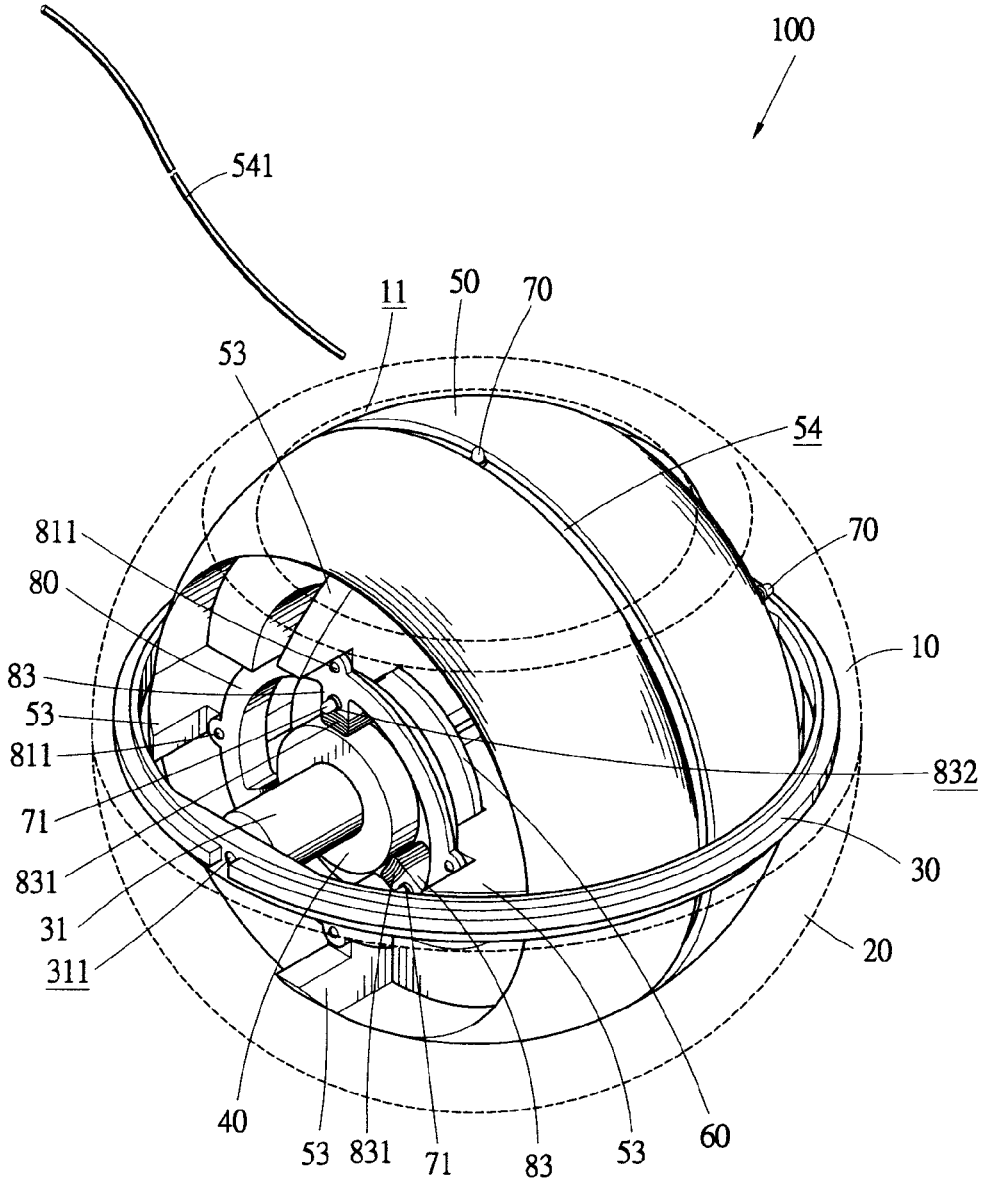
FIG. 8 is a perspective view of an illuminating wrist exerciser constructed in accordance with a second embodiment of the present invention.
Figure 9:
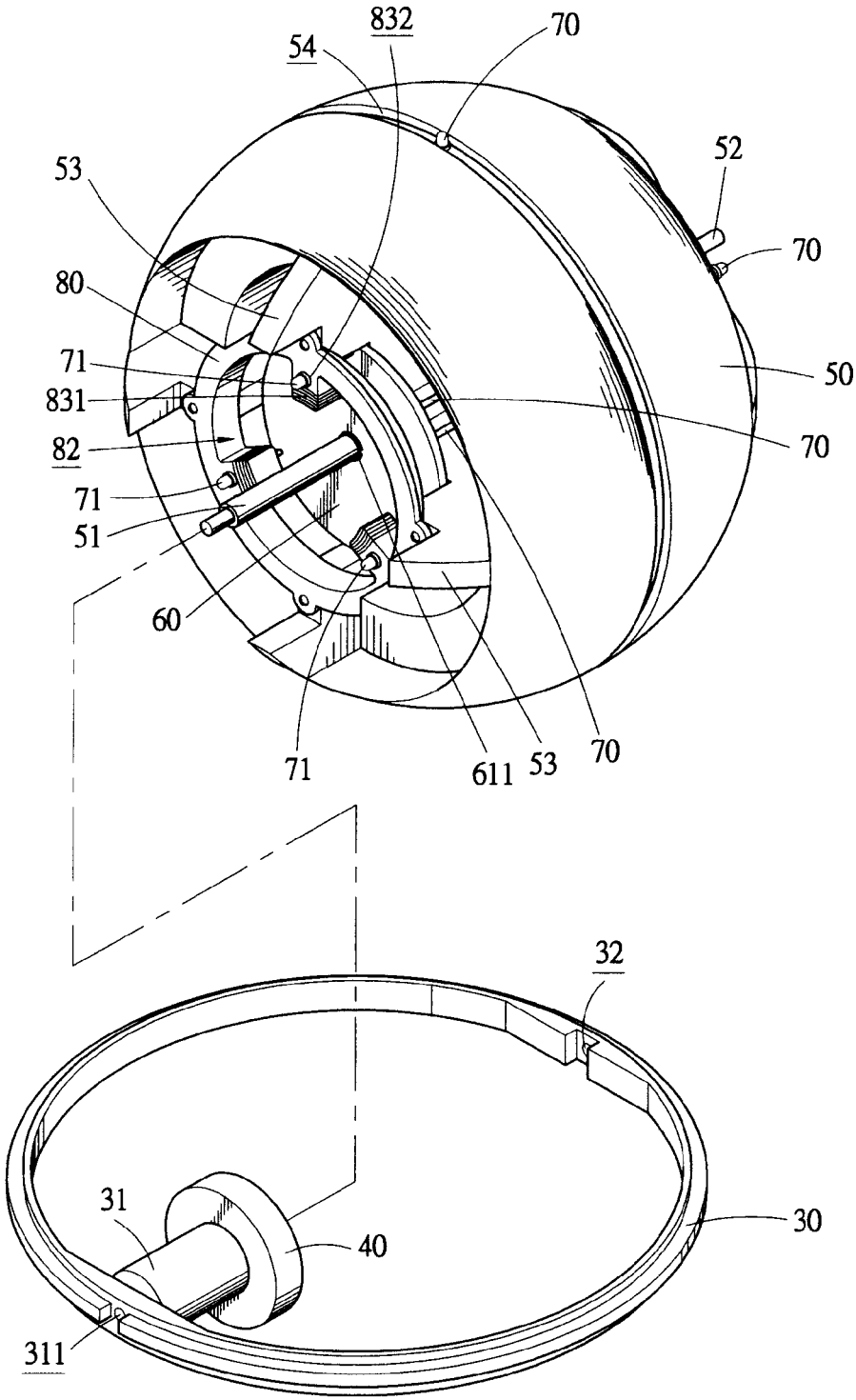
FIG. 9 is a partial exploded view illustrating illuminators mounted to coil retention stems of a coil holder of the wrist exerciser of the present invention.

Referring to FIGS. 8 and 9, a wriest exerciser constructed in accordance with a second embodiment of the present invention is shown, also designated with reference numeral 100 for simplicity. The second embodiment wrist exerciser forms at least one fixing holes 832 in each of the coil retention stems 83 for receiving and fixing an illuminator 71 therein to securely retain the illuminator 71.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An illuminating wrist exerciser, comprising:

an upper casing member and a lower casing member, which are hollow and mate each other to define an interior space therebetween, the upper casing member forming an opening in a top portion thereof;

a ring, which is set on an upper circumferential edge of the lower casing member, the ring forming a joint seat and a hole opposite to each other, the joint seat forming therein a bore;

a magnetic ring, which is coupled to the joint seat of the ring;

a rotor, which is rotatably received in the interior space between the upper and lower casing members and has axles extending in opposite direction from opposite ends of the rotor, the rotor partially projecting beyond the opening defined in the upper casing member for receiving an external force for initiation of rotation thereof, the axles being respectively fit into the bore of the joint seat and the hole of the ring;

an illumination control circuit board, which functions to realize power conversion and control of illumination, the illumination control circuit board being fit over one of the axles of the rotor and fixed to a recess defined in the corresponding end of the rotor to be rotatable in unison with the rotor;

a plurality of illuminators, which are arranged on a circumferential surface of the rotor and are electrically connected to the illumination control circuit board to be driven by the illumination control circuit board for lighting; and a coil holder, which is fixed to the recess on the end of the rotor, the coil holder having an inner circumference to which at least one pair of coils is mounted, each coil being electrically connected to the illumination control circuit board, the coil holder forming a bore in which the magnetic element is received in such a way that the magnetic element and the coils are set in a co-planar arrangement, whereby when the coils are rotated with the rotor and orbiting around the magnetic element, electrical power is induced therein for supplying to the illumination control circuit board.

2. The illuminating wrist exerciser as claimed in claim 1, wherein the upper casing member has a lower circumferential edge forming a pair of slots.

3. The illuminating wrist exerciser as claimed in claim 1, wherein the upper casing member forms in a top portion thereof an opening.

4. The illuminating wrist exerciser as claimed in claim 1, wherein the lower casing member has an upper circumferential edge on which a pair of lugs is formed.

5. The illuminating wrist exerciser as claimed in claim 1, wherein joint seat has an inner end forming a coupling section.

6. The illuminating wrist exerciser as claimed in claim 5, wherein the coupling section is provided, at a free end thereof, resilient retention tabs.

7. The illuminating wrist exerciser as claimed in claim 1, wherein the magnetic element forms therein a hole.

8. The illuminating wrist exerciser as claimed in claim 1, wherein the magnetic element 40 is not limited to any specific type and a magnetic ring.

9. The illuminating wrist exerciser as claimed in claim 1, wherein one of the axles of the rotor forms at least one circumferential groove.

10. The illuminating wrist exerciser as claimed in claim 9, wherein the circumferential groove receives a C-clip therein.

11. The illuminating wrist exerciser as claimed in claim 1, wherein the recess one the end of the rotor forms therein a plurality of mounting portions.

12. The illuminating wrist exerciser as claimed in claim 11, wherein each mounting portion of the rotor forms an inner-threaded hole.

13. The illuminating wrist exerciser as claimed in claim 1, wherein the circumferential surface of the rotor forms at least one circumferential slot.

14. The illuminating wrist exerciser as claimed in claim 1, wherein the rotor forms a plurality of through holes.

15. The illuminating wrist exerciser as claimed in claim 1, wherein the coil holder forms a plurality of mounting holes.

16. The illuminating wrist exerciser as claimed in claim 1, wherein the coil holder forms on the inner circumference thereof at least one pair of coil retention stems.

17. The illuminating wrist exerciser as claimed in claim 16, wherein the coils are mounted to the coil retention stems respectively.

* * * * *